United States Patent [19]

von Beckmann

[11] 4,176,456

[45] Dec. 4, 1979

[54] AUTOMATIC INTEGRATING LINER

[75] Inventor: Helmuth von Beckmann, Columbia, S.C.

[73] Assignee: Canron, Inc., New York, N.Y.

[21] Appl. No.: 844,819

[22] Filed: Oct. 25, 1977

[51] Int. Cl.[2] ..... E01B 33/00

[52] U.S. Cl. ..... 33/1 Q; 33/287

[58] Field of Search ..... 33/1 Q, 287, 338, 144, 33/180 R, 1 LE, 146; 104/8

[56] References Cited

U.S. PATENT DOCUMENTS

| | | | |
|---|---|---|---|
| 2,485,810 | 10/1949 | Bienfait | 33/1 Q |
| 4,031,625 | 6/1977 | Thumrer | 33/1 Q |

FOREIGN PATENT DOCUMENTS

| | | | |
|---|---|---|---|
| 241510 | 7/1965 | Austria | 33/1 Q |
| 471413 | 8/1975 | U.S.S.R. | 33/1 Q |

*Primary Examiner*—Willis Little

*Attorney, Agent, or Firm*—Wenderoth, Lind & Ponack

[57] ABSTRACT

A track aligning device for monitoring the curvature of a track and adjusting the track successively to correct the curvature incorporates two taut wires mounted on a car or cars running on the track, the wires each defining two chords each extending between a pair of spaced points located on the track center line. Preferably the cords overlap. Each chord operates as a reference line which cooperates with a respective measuring device. A first measuring device located nearer the rearward point of the first chord derives a voltage which is sampled at equal intervals, say 2 meters, as the aligning device passes along the track. The voltages are summed and averaged electrically and a voltage equivalent to the mean displacement of the track from the first chord is obtained. The second measuring device is located nearer the rearward point of the second chord and derives a voltage equivalent to the actual displacement at that position of the track with respect to the second chord. This voltage is compared electrically with the mean voltage and an error voltage is derived and used to operate a servo-assisted aligning mechanism to adjust the track to the left or right as necessary. In a preferred embodiment the device can also adjust the superelevation of the track to meet the necessary value as computed on the basis of track curvature and train speed.

15 Claims, 1 Drawing Figure

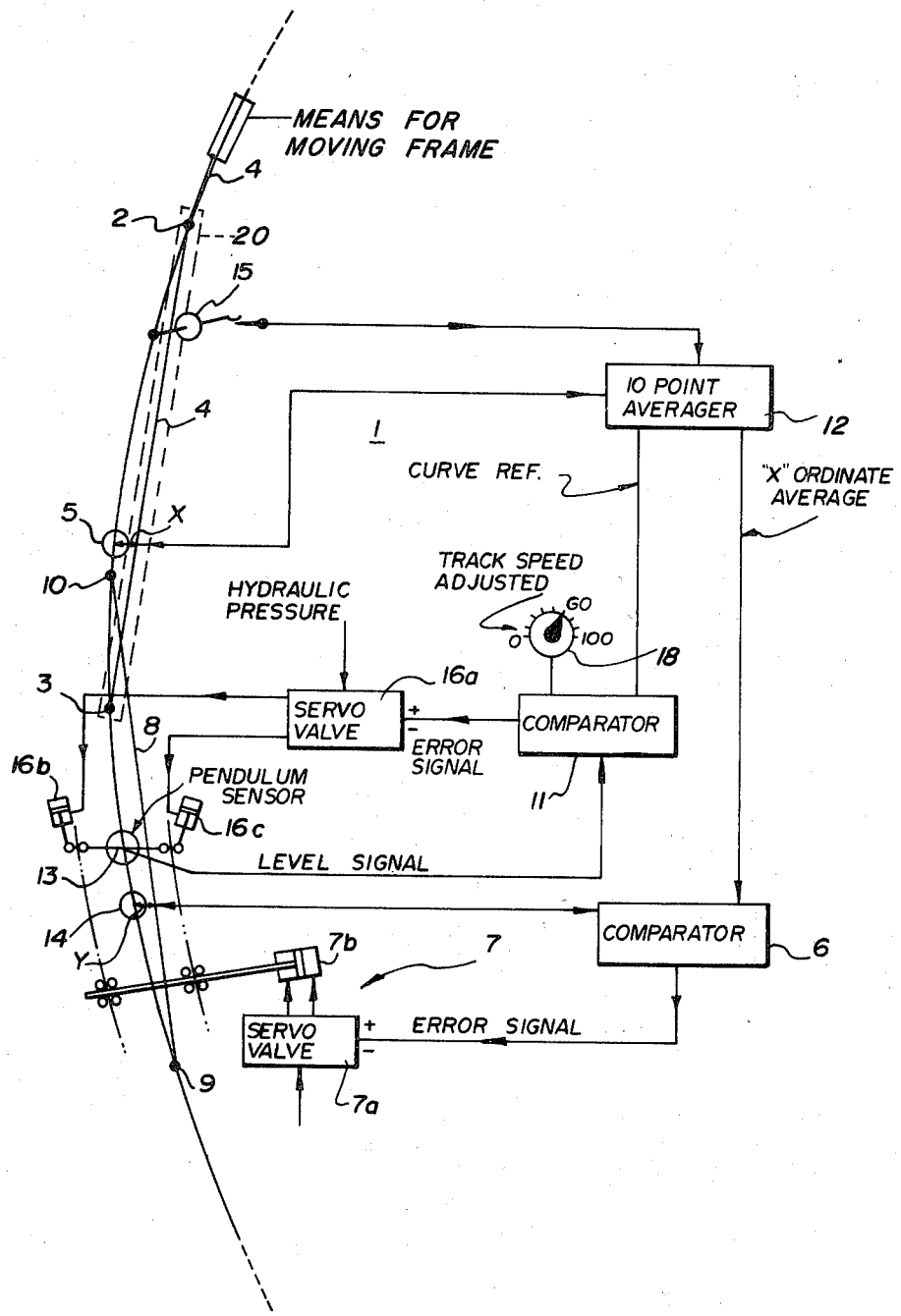
MEANS FOR MOVING FRAME
4
2
20
15
10 POINT AVERAGER
12
1
CURVE REF.
"X" ORDINATE AVERAGE
5
X
10
TRACK SPEED ADJUSTED
HYDRAULIC PRESSURE
GO
0
100
18
3
16a
SERVO VALVE
+
-
COMPARATOR
8
ERROR SIGNAL
16b
PENDULUM SENSOR
11
16c
LEVEL SIGNAL
13
14
Y
7b
7
COMPARATOR
6
SERVO VALVE
+
-
ERROR SIGNAL
9
7a

AUTOMATIC INTEGRATING LINER

BACKGROUND OF THE INVENTION

This invention relates to track alignment devices and, more particularly, to track alignment devices utilising a "chord system" to obtain track alignment error and correct track alignment.

It has previously been proposed in Russian Pat. No. 471,413 which was granted on May 25, 1975 to Turovskiy et al, to use a wire stretched between forward and rearward stations of a track alignment device, the wire serving as a chord of a curved section of the track over which the alignment device is passing to establish a datum or reference line. A first measuring device located relatively near the forward station cooperates with the wire to measure the distance of the track at successive points from the reference line. A predetermined number of measurements are obtained and averaged. A second measuring device located relatively near the rearward station cooperates with the wire to measure successively the distance from the reference line of the track at a point immediately forwardly of the already corrected track portion. The actual value obtained is compared with the mean value obtained from the first measuring device and an error signal generated if there is a difference. The error signal causes an alignment mechanism to shift the track in a direction left or right and by an amount to remove or reduce the error.

This prior system suffers from the disadvantage that the length of the chord is limited physically by the practical problems associated with supporting the wire on rail cars. This places a practical limitation on the precision of the measurements because the longer the chord the more precise the measurements.

Another disadvantage of the prior system is that because the first measuring device is located near the forward end of the wire then, if the forward end of the wire is on a badly misaligned point on the track, a large deviation from a "true" displacement from the reference will be present in the reading obtained.

SUMMARY OF THE INVENTION

The present invention comprises an apparatus for reducing railroad track position errors comprising a first measuring system having a leading point and a trailing point and means for establishing a reference line between said points; a measuring means located between said points adapted to measure a track position value relative to said reference line; means to move said first measuring system over a section of track and to measure a series of said track position values to store them and to average them; a track correcting means attached to and trailing said first measuring system; an independent track location sensing system for said track correcting means, which locating sensing system includes a leading point and a trailing point and means for establishing a second reference line between those points; sensor means located between the said points of the second reference line, adapted to sense a track location value relative to said second reference line; means to compare said average position value with said location value and provide a position error value; and means for applying said position error value to control the operation of the track position correcting means to reduce an existing track position error.

In a preferred configuration the first reference line is a chord stretched between the leading and trailing points of the first measuring system and the second reference line is a chord stretched between the leading and trailing points of the track location sensing system. The chords may overlap each other.

The present invention further comprises a method of reducing railroad track position errors comprising the steps of passing a measuring system over a section of the track and measuring track position values relative to the measuring system at a series of points throughout the section; automatically summing and averaging the measured position values to obtain an average position value; passing track correcting means equipped with a track location sensing system through the same section of track, obtaining a track location value from the track location sensing system, comparing the track location value with the average position value to obtain a position error value and applying the position error value to control the operation of track position correcting means to reduce an existing track position error.

In a described embodiment, the step of re-measuring a track position value after the operation of the track position correcting means and re-summing and re-averaging the track position values to obtain a new average position value is taken.

BRIEF DESCRIPTION OF THE DRAWINGS

In the drawing which illustrates an embodiment of the invention, the apparatus is shown in diagrammatic form.

DESCRIPTION OF THE PREFERRED EMBODIMENT

An apparatus for calculating the track position error and realigning railway track is shown generally at 1. A first measuring system comprises leading and trailing points 2,3 being conveniently located on rail engaging buggies forming a frame 20 and means to move the frame and buggies over the track, each point being located at the track center line. Between the points 2,3, a chord 4 is formed which is conveniently merely a 20 meter long wire pulled taut between the two points. A measuring device 5 of any suitable design is located at a predetermined point between points 2,3 for obtaining the distance of the chord from the track at the predetermined point. Conveniently, the measuring device is a fork which engages the wire and pivots to the right or left relative to a frame mounted indicator thereby giving the amount of deviation between the track and chord. The frame mounted indicator is, suitably, a rotary differential transformer which derives an analog voltage dependent on the deviation. The measuring device 5 is operated in conjunction with a distance measuring apparatus shown schematically at 15 such that at convenient increments, for example every two meters, a contact is closed to sample the analog voltage on the transformer.

An averaging apparatus 12 receives the analog voltages sampled. The averaging apparatus 12 is designed to receive the analog voltages sampled at ten consecutive points, sum them and obtain a mean track position value over the twenty meter distance travelled. The apparatus 12 may conveniently include an analog to digital converter, the digital values being subsequently summed and divided by the number of samples. It should be understood that as the apparatus traverses the track continuously the first of the ten samples is dropped and a new sample is added to the remaining nine and in this way a running average is obtained every 2 meters.

A second measuring system comprises leading and trailing points 9,10 also conveniently located at the track center line on rail engaging buggies forming a second frame. Associated with the second frame and stretched between the points 9,10 is a second 20 meter long taut wire forming a second chord or reference line 8 and a second measuring device 14 which operates in a manner identical to that of measuring device 5 and obtains the track distance from chord 8 at successive points.

Comparator 6, well known in the art, is provided which utilises as two inputs, respectively, the mean track distance calculated by averager 12 and the track distance "y" obtained by the second measuring device 14. The magnitude of the voltage output from the comparator 6 depends on the difference between the mean track distance and the track distance "y".

The error output voltage from comparator 6 is forwarded to track correcting means 7 which can be any suitable device for shifting track laterally as is known in the art, e.g. a servo valve *7a* controlling hydraulic jack *7b*. The track correcting means 7 thereby realigns the track in accordance with the magnitude and sign of the error signal from comparator 6 in a sense to reduce or remove the error.

In an arrangement which has proved very satisfactory, the measuring devices 5 and 14 were located 4 meters from the rear points 3 and 9 of their respective chords and the chords were overlapped such that the point 3 of the first chord was adjacent the midpoint of the second chord and the point 10 of the second chord was adjacent the mid point of the first chord. The overlapping of the chords conveniently reduces the overall length of the apparatus but there is a limit to the overlapping as excessive overlapping would tend to reduce the accuracy of the results. This is because the ten sample readings obtained and stored by the first measuring device 5 are normally obtained over e.g. the twenty meters immediately behind device 5, ten of which meters are behind the particular point being measured by device 14 and having in the meantime been corrected so that half of the stored samples upon which the mean value is obtained are taken on a section of the track which has subsequently been corrected. Thus, the distance between the measuring devices 5 and 14 determines the maximum distance over which the samples can be taken.

Because of the overlapping chords it is possible to incorporate a feedback provision into the averager 12 by arranging that the sensing device 14 and track correcting means 7 are located at point 3, i.e. the trailing end of the first chord. Thus, the trailing end 3 of chord 4 is continuously moved to a corrected position on the track as the track continuously moved to a corrected position on the track as the track correcting device 7 operates. The corrected point 3 represents a more exact reference point than uncorrected point 3 and so any value measured by measuring device 5 when chord 4 terminates at the corrected point 3 is, obviously, more accurate. The system can, therefore be arranged to derive measurements from measuring device 5 while the point 3 is on the corrected portion of the track, i.e. immediately after operation of the track correcting device, these being the values which are stored and sampled.

As an additional feature of the invention it is possible to incorporate a device for measuring the superelevation of the track. According to the A.R.A. standard, the superelevation of a railroad track "x" is given by the formula $E=0.0007\ V^2D$ where:

E = the superelevation in inches,

V = the proposed train speed in miles per hour, and

D = the curvature of the track in degrees measured as the angle subtended by the radii from a 100 foot chord.

The device includes a comparator 11 to which is fed an output from the averager 12 which output is obviously related to the track curvature D.

The second input to the comparator 11 originates by the provision of a track speed adjuster 18. If the proposed train speed V, for example, is 60 miles/hr., this value is simply selected on the track speed adjuster whereby it is fed to the comparator 11.

The third input to the comparator 11 is derived from a pendulum sensor 13 which is carried by the apparatus on the track center line near the sensing device 14. The sensor 13 is well known in the art and derives an analog voltage the magnitude and sign of which depends on by how much the elevation of the outer rail of the curve differs from the inner rail.

The comparator 11 compares this superelevation with $0.0007\ V^2D$ and any resultant signal denotes the magnitude of the track superelevation error.

This signal commands a servo valve 15 to operate a hydraulic lifting jack **16*b* or 16*c*** depending on which rail has to be lifted.

It should be understood that the voltages passed to the first two inputs of the comparator have to be matched to the voltage produced by the pendulum and, thus, constants based on the parameters of the pendulum must be used to process the voltages on the first two inputs. This is preferably done in the comparator.

While the invention has been described as carried out in specific embodiments, it is not desired to be limited thereby but rather it is intended to cover the invention within the spirit and scope of the appended claims.

What is claimed is:

1. A method of reducing railroad track position errors comprising the steps of passing a measuring system over a section of the track, the measuring system having a first reference line extending between a first leading point and a first trailing point on the track, and measuring track position values relative to the measuring system at a series of points throughout the section; automatically summing and averaging the measured position values to obtain an average position value; passing track correcting means equipped with a track location sensing system through the same section of track, the track location sensing system having a second reference line extending between a second leading point and a second trailing point on the track, obtaining a track location value from the track location sensing system, comparing the track location value with the average position value to obtain a position error value and applying the position error value to control the operation of track position correcting means to reduce an existing track position error.

2. A method as claimed in claim 1 which further comprises the step of re-measuring a track position value after the operation of the track position correcting means and re-summing and re-averaging the track position values to obtain a new average position value.

3. A method as claimed in claim 1 in which half of the points at which track position values are measured are on the corrected portion of the track section.

4. A method as claimed in claim 1 in which a running average position value is obtained by progressively dropping off the value obtained by the measuring system at a first sequential one of the series of points and adding on a new value obtained at a successive point.

5. A method as claimed in claim 4, in which a track location value is obtained from the track location sensing system at a second series of points on the section and the location value at each of these points is compared with the running average position value.

6. A method as claimed in claim 5 in which the first series of points and the second series of points coincide.

7. A method as claimed in claim 1 in which the track correcting means is passed over the track section immediately subsequently to the passing of the measuring system.

8. A method as claimed in claim 1, in which the chords overlap each other.

9. A method as claimed in claim 8 in which the first trailing point is located adjacent the track position correcting means.

10. A method as claimed in claim 9, in which the location at which the track location value is obtained is midway between the first and last points of the first series of points.

11. An apparatus for reducing railroad track position errors comprising: a first measuring system having a leading point and a trailing point and means for establishing a reference line between said points; a measuring means located between said points for measuring a track position value relative to said reference line; means to move said first measuring system over a section of track for enabling said measuring means to measure a series of said track position values at a series of points extending over a specified distance along the track; means connected to said measuring means to store the series of track position values and to average them; a track correcting means attached to and trailing said first measuring system along the track; an independent track location sensing system for said track correcting means, which locating sensing system includes a leading point and a trailing point and means for establishing a second reference line between said lastmentioned points; sensor means located between the said points of the second reference line, for sensing a track location value relative to said second reference line; comparator means connected to said means to store and average the track position values and to said sensor means to compare said average position value with said location value and provide a position error value; and means connected to said comparator means for applying said position error value to control the operation of the track position correcting means to reduce an existing track position error.

12. An apparatus as claimed in claim 6, wherein the first reference line is a chord extending between the leading and trailing points of the first measuring system and in which the second reference line is a chord extending between the leading and trailing points of the track location sensing system.

13. An apparatus as claimed in claim 6, in which the chords overlap each other.

14. Apparatus as claimed in claim 13, in which the trailing point of the first chord is located adjacent the track position correcting means.

15. Apparatus as claimed in claim 11, in which the measuring means is positioned remote from the leading and trailing points of the first chord and the sensor means is positioned remote from the leading and trailing points of the second chord.

* * * * *